United States Patent [19]

Otte, Jr.

[11] 4,294,298

[45] Oct. 13, 1981

[54] IMPACT CUTTING TOOL

[76] Inventor: Otho M. Otte, Jr., 719 Avenue "A", Apt. 705 ID, Springfield, Mich. 49017

[21] Appl. No.: 16,392

[22] Filed: Mar. 1, 1979

[51] Int. Cl.[3] ..... B27L 7/00

[52] U.S. Cl. ..... 144/193 C; 254/104

[58] Field of Search ..... 254/104; 144/193 R, 144/193 C, 193 D, 193 E; 173/91

[56] References Cited

U.S. PATENT DOCUMENTS

| | | | |
|---|---|---|---|
| 1,662,538 | 3/1928 | Richmond et al. | 173/91 X |
| 2,475,041 | 7/1949 | Mattson | 173/91 X |
| 2,629,985 | 3/1953 | McDowell | 173/91 |
| 2,814,475 | 11/1957 | Jay | 144/193 D |
| 2,934,984 | 5/1960 | Woodman | 173/91 X |
| 3,050,095 | 8/1962 | Prather | 144/193 R |
| 3,377,052 | 4/1968 | Hagen | 254/104 |
| 3,381,763 | 5/1968 | Matson | 173/91 |
| 3,568,657 | 3/1971 | Gue | 173/91 X |

FOREIGN PATENT DOCUMENTS

| | | | |
|---|---|---|---|
| 26353 | 6/1953 | Finland | 144/193 R |
| 48054 | 2/1964 | Poland | 144/193 B |

*Primary Examiner*—W. D. Bray

*Attorney, Agent, or Firm*—Fisher, Gerhardt, Crampton & Groh

[57] ABSTRACT

An impact cutting tool for splitting logs and cutting kindling having a cutting edge and an integral wedge arrangement to assist the splitting action of the cutting edge.

12 Claims, 3 Drawing Figures

IMPACT CUTTING TOOL

This invention relates to impact cutting tools and more particularly to cutting tools of the type used to split wood.

A variety of fireplace tools are available for operating fireplaces primarily for the purpose of moving logs or for removing ashes and the like from the fireplace. However, cutting tools such as axes or hatchets seldom are made available for use in the vicinity of the fireplace, primarily because of the possibility of missing during the swing of such a tool and causing injury or damage. Also the use of such tools in the location of the fireplace is undesirable because of the large impact forces that are required to form a split in a log and such forces are transmitted to the hearth or to the floor adjacent to the fireplace.

It is an object of the invention to provide a cutting tool for splitting wood into more convenient size for fuel or kindling.

Another object of the invention is to provide a cutting tool which is safe and convenient to use and is adapted for use in the immediate vicinity of an indoor fireplace.

Another object of the invention is to provide a cutting tool for wood which is particularly adapted as a fireplace accessory to match other accessories such as pokers, tongs and the like.

A further object is to provide a cutting tool having provision for means to assist the splitting action of the cutting edge of the tool.

A further object is an impact cutting tool having a particularly shaped cutting edge and wedge surfaces which are complementary to each other making it possible to easily split logs and properly guide the tool during its splitting operation.

The impact tool for splitting logs includes an elongated rod like guide portion slideably supporting an impact or hammer member having opposed impact surfaces adapted to strike a primary anvil or a secondary anvil disposed at opposite ends of the guide member, respectively. A tool extends from the primary anvil generally coaxially with the guide member and the cutting edge is concavo-convex so that it cuts a trough at one side of a wood split and forms a bead at the other side of the wood split. In use, the cutting edge of the tool can be accurately located on the surface of the wood to be cut and repeated blows can be used to transmit relatively small, easily controlled increments of force to cause a split as opposed to the large force required by an ax. Also the smaller increments of striking force are more easily resisted by inertia of the log so that the loads imposed on the hearth or floor are reduced. A wedge portion is formed between the cutting edge and the primary anvil by a bend in the tool which forms a general S shaped configuration with the curved portions disposed in a plane bisecting the cutting edge of the tool. One of the curved portions of the S has a curved surface complementary to the curved surface of the cutting edge so that it engages the wood path formed in one of the split sides of the wood member being cut.

These and other objects of the invention are accomplished by the invention disclosed in the following description and illustrated in the drawings in which.

Figure 1:
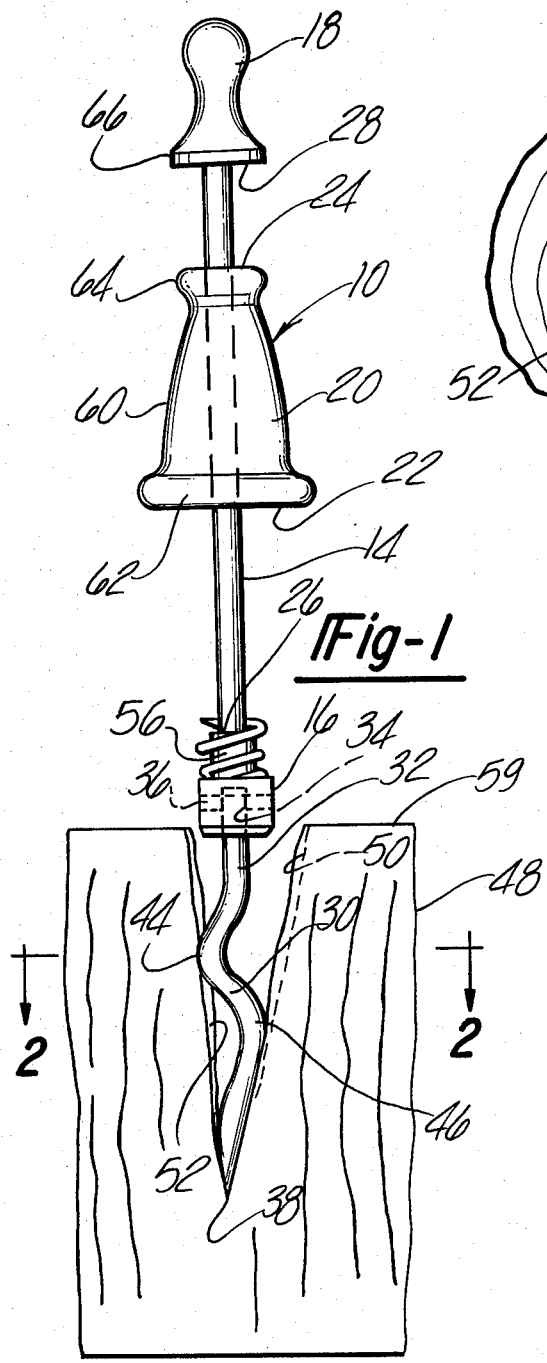
FIG. 1 is an elevational view of the impact cutting tool embodying the invention.

An impact tool for splitting logs is designated generally at 10 and includes a generally elongated body formed by a rod shaped guide member 14 having a generally cylindrical collar 16 rigidly fixed as by welding or the like to one end of the guide member 14. The opposite end of the guide member or slide rod 14 has a formed handle 18 fixed to the rod 14. A slideable impact member or handle 20 is mounted on the rod 14. The impact handle 20 is provided with oppositely facing impact surfaces 22 and 24 which are adapted to engage an impact area 26 formed on the collar 16 and an impact area 28 formed on the top handle 18, respectively.

A tool 30 extends generally axially of the guide member 14 and away from the collar 16. The tool 30 has a shank 32 which may be detachably received in a blind bore 34 and held in position by a latch pin 36 passing through aligned openings in the shank 32 and collar 16. This makes it possible to remove the tool and substitute other tools. However, if preferred, the tool 30 may be permanently fixed relative to the collar 16 so that the shank 32 is a continuation of the guide rod 14.

Figure 3:
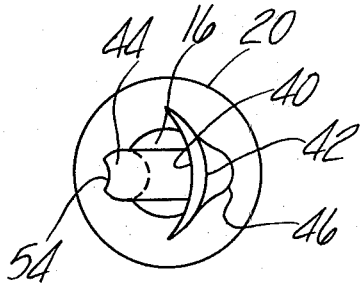
FIG. 3 is an end view of the cutting tool seen in FIG. 1.

The tool 30 has a cutting edge 38 with a concave splitting surface 40 and an opposed convex splitting surface 42 as best seen in FIG. 3. The tool 30 is bent in an S shape between the shank 32 and the cutting edge 38 so that the S lies in an imaginary plane bisecting the concavo-convex cutting edge 38. The upper and lower curved surfaces 44 and 46 of the S shaped portion form wedge means which as seen in FIG. 1 are adapted to engage opposite sides of a split formed in a log 48.

Figure 2:
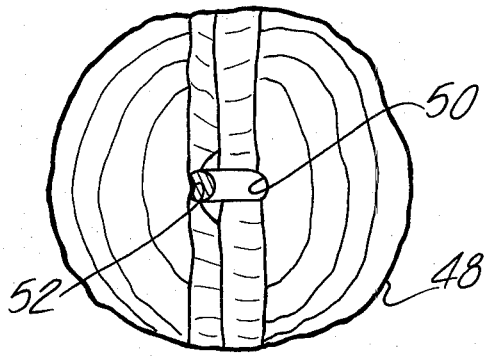
FIG. 2 is a cross-sectional view taken on line 2—2 in FIG. 1.

As best seen in FIG. 2, when a tool is operated to split a log, one side of the split results in a trough 50 and the other side of the split results in a bead 52. The curved portion 46 of the S shaped tool shank is guided in the groove 50 formed at one side of the split in the log. The other curved portion 44 is formed with a hollow or concave guide surface 54, best seen in FIG. 3, which is generally complementary to the concave splitting surface 40 and to the resultant bead 52 formed in the split log 48.

The collar 16 has a boss 56 which acts as a guide for a compression spring 58 seated to surround the boss 56 and the rod 14. During use of the tool 10 the cutting edge 38 is placed on a selected location on the top surface 59 of the log 48 and the impact handle 20 is gripped and raised upwardly toward the handle 18. The handle 20 is moved swiftly downwardly on the guide rod 14 so that the impact surface 22 engages the impact area 26 at the top of the collar 16. Just prior to engagement of the impact surface 22 and the area 26, the spring 58 engages the impact handle 20 and absorbs a small portion of the load.

The impact handle 20 is of substantial weight so that its momentum is transmitted to the collar 16 and to the tool 30. The impact handle 20 has a generally frustoconical shape which forms the gripping surface 60. The lower end of the grip surface 60 is bounded by a relatively large flange 62 which forms a guard to protect the hand of the user. Similarly, the upper portion of the grip surface 60 is bounded by a flange 64 which is slightly smaller than the flange 62 and forms a guard for the top part of the hand gripping the surface 60. The tapered surface of the grip 60 affords a comfortable angle for the hand of the operator during operation of the cutting tool 10.

The top handle 18 is held with one hand during operation of the tool and the other hand is used to move the impact handle 20. The handle 18 forms a secondary anvil which may be struck with the impact handle 20 to remove the tool from incompleted or impossible splits in a log. The lower part of the handle 18 is formed with a relatively large flange 66 which protects the hand of the user. The flange 66 makes it uncomfortable to hold the tool by extending the fingers over the edge so that it might be struck accidentally by the impact handle 20.

During the cutting operation, an operator holds the upper handle 18 in one hand and places the concavo-convex cutting edge 38 in a selected position on a log to make a split. By way of example, the cutting edge 38 is placed generally axially of a round log and the cutting operation is initiated by striking the impact surface 22 with the impact handle 20 repeatedly until the split is initiated. The cutting action of the concavo-convex cutting edge 38 is such that a trough 50 is cut at one side of the split and a bead 52 is formed at the other side of the split. The convex portion 42 of the cutting tool follows the trough 50 and the concave guide surface 54 on the curved portion 44 follows the bead 52. The opposed curved portions 44 and 46 act as a wedge which serves to assist the splitting action by engaging the opposite sides of the split.

The curved cutting edge 38 is particularly adapted for making small cuts for splintering or cutting kindling by placing the tool in a successive positions as indicated by the arcuate lines 68 in FIG. 2. In that instance, the cutting operation is such that smaller pieces are separated from the larger piece of log to serve for kindling to start the fireplace fire.

It will be seen that an impact tool for splitting logs for fireplaces has been provided wherein an impact member is guided in a path to strike a primary anvil to split logs or form gouges of smaller pieces of wood for kindling. Also, the impact member can be moved in the opposite direction to strike a secondary anvil to remove the fireplace tool from difficult or impossible cuts. The cutting edge of the tool is concavo-convex so that it forms a trough at one side and a bead at the opposite side of a split in a log. The trough and bead coact with the other portions of the tool to act as a guide to direct the tool and to act as a wedge means to assist the splitting operation.

The embodiments of the invention in which an exclusive property or privilege is claimed are defined as follows:

1. An impact tool for splitting logs comprising; an elongated guide member, a primary anvil formed at one end of said guide member, a hammer element mounted on said guide member for sliding movement on said guide member and having an impact surface engageable with said anvil, a tool supported from said anvil and extending generally axially of said guide member, said tool including a curved cutting edge in spaced relation of said anvil, wedge means formed by said tool between said anvil and said cutting edge to engage wood and widen the split initiated by said cutting edge, said wedge means being formed by a tool portion disposed to one side of the axis of said guide member and having a guide surface conforming to the shape of said curved cutting edge and operable to engage and be guided by the wood path cut by said cutting edge.

2. The combination of claim 1, wherein said cutting edge has a concave splitting surface facing axially away from one side of said tool, said wedge means being disposed to the same side of the axes of said guide member.

3. The combination of claim 1, wherein said primary anvil has a spring member operable to engage said impact surface prior to its engagement with said primary anvil.

4. The combination of claim 1, wherein said hammer member has a generally conical hand grip surface diverging toward said anvil.

5. The combination of claim 1, wherein said cutting tool is detachable from said anvil.

6. The combination of claim 1, and further comprising an auxiliary anvil on said guide member in spaced relation to said first mentioned anvil to be struck by said hammer element to remove said tool from a cutting position in a log.

7. The combination of claim 1, wherein said wedge means is formed by an S-shaped portion in a shank of said tool, said S-shaped portion having oppositely extending curve portions engageable with opposite sides of a log split tool accomplish a wedging action.

8. The combination of claim 7, wherein one of said curve portions has a concave guide surface engageable with a bead in the surface of the wood formed at the concave side of said concavo-convex cutting edge.

9. The combination of claim 8, wherein said S shaped portion lies in an imaginary plane bisecting said concavo-convex cutting edge.

10. An impact tool for splitting logs comprising: an elongated guide member, an anvil formed at one end of said guide member, a hammer element mounted on said guide member for sliding movement on said guide member and having an impact surface engageable with said anvil, a tool supported from said anvil and extending generally axially of said guide member, said tool including a curved cutting edge in spaced relation to said anvil, wedge means formed by said tool between said primary anvil and said cutting edge to engage wood and widen the split initiated by said cutting edge, said tool having a concave splitting surface facing in one direction and said wedge means having a complementary concave surface facing in the same direction to engage a wood bead cut by said cutting edge.

11. The combination of claim 10, and further comprising an auxiliary anvil on said guide member in spaced relation to said first mentioned anvil to be struck by said hammer element to remove said tool from a cutting position in a log.

12. An impact tool for splitting logs comprising; an elongated rod shaped guide member, a primary anvil fixed at one end of said guide member, a secondary anvil formed at the other end of said guide member, a hammer member slideably mounted on said guide member for movement between said anvils and having opposed impact surfaces for engaging said primary and secondary anvils, respectively, a tool extending from said primary anvil in a direction opposite from said guide member and generally axially relative thereto, said tool including a curved cutting edge forming concavo-convex splitting surfaces, wedge means disposed between said cutting edge and said primary anvil, said wedge means having a general S shaped configuration and presenting opposed curved portions operable to engage opposite sides of a split formed by said cutting edge, one of said curved surfaces having a guide portion complementary to the concave side of said cutting tool and the other of said curved portions having a guide surface complementary to the convex side of said cutting tool.

* * * * *